US007299834B1

(12) United States Patent
Platt

(10) Patent No.: US 7,299,834 B1
(45) Date of Patent: Nov. 27, 2007

(54) FUNNEL ASSEMBLY WITH OPEN/CLOSED VALVE

(76) Inventor: Richard Booth Platt, 381 Country Club La., Grosse Pointe Farms, MI (US) 48236

( * ) Notice: Subject to any disclaimer, the term of this patent is extended or adjusted under 35 U.S.C. 154(b) by 0 days.

(21) Appl. No.: 11/492,491

(22) Filed: Jul. 25, 2006

(51) Int. Cl.
*B65B 1/04* (2006.01)

(52) U.S. Cl. ..... 141/344; 141/301

(58) Field of Classification Search ..... 141/331–345, 141/199–204, 301, 351; 222/501
See application file for complete search history.

(56) References Cited

U.S. PATENT DOCUMENTS 1,094,098 A 4/1914 Rakottyay
2,715,488 A * 8/1955 Conlon ..... 141/95
4,489,858 A * 12/1984 Pritchitt ..... 222/182
5,004,024 A * 4/1991 Rezmer et al. ..... 141/298
5,950,697 A 9/1999 Hobbs
6,341,631 B1 * 1/2002 Hobbs ..... 141/344
6,390,148 B2 * 5/2002 Martin ..... 141/39

* cited by examiner

*Primary Examiner*—Steven O. Douglas
(74) *Attorney, Agent, or Firm*—Clark Hill PLC

(57) ABSTRACT

A funnel assembly is provided for transferring material between two containers. The funnel assembly includes a funnel forming a reservoir and a spout of substantially circular cross-section that tapers along a longitudinal axis between an inlet end joined to the funnel and a distal outlet end. The spout includes an inside surface. The funnel assembly also includes a substantially spherical occluding element disposed in the spout. The occluding element has a periphery larger than the outlet end of the spout and smaller than the inlet end. The occluding element includes a resiliently flexible sealing member extending circumferentially therearound for selectively engaging and conforming to the inside surface of the spout at any of a plurality of angular displacements of the occluding element to establish an impervious seal within the spout between the inlet and outlet ends as a result of gravity and material weight acting upon the occluding element.

26 Claims, 3 Drawing Sheets

FUNNEL ASSEMBLY WITH OPEN/CLOSED VALVE

BACKGROUND OF THE INVENTION

1. Field of the Invention

The present invention relates to a funnel, and more particularly to a funnel assembly having an open/closed valve or shut-off element.

2. Description of Related Art

Many prior approaches to providing funnels with shut-off elements to stop the outflow of fluid, material, or other substance have been proposed. Most approaches, however, are complex and expensive to manufacture, given that they require a valve or occluding element to have substantial weight or spring pressure to assure a complete seal against a hard-to-manufacture distinct valve seat formed within a spout of the funnel.

One such funnel is disclosed in U.S. Pat. No. 1,094,098 (the '098 patent) to Rakottyay and features a valve 22 which is raised by wires 23 and 26. A hook portion 28 of the wire 26 is brought into engagement with a rim of a container to open the valve 22 thereby allowing fluid held in the funnel 10 to pass through an outlet end of a spout 12 into the container. The valve or occluding element 22 of the '098 patent is mounted in a reservoir portion of the funnel 10 and its exterior shape must match substantially exactly with tapered walls of the reservoir portion in order to provide an adequate liquid-tight seal. A further disadvantage of approaches such as disclosed in the '098 patent is that the entire portion of residual fluid in the spout will drain therefrom even after the valve or occluding element closes, thereby maximizing spillage of excess fluid when one desires to halt the outflow of fluid from the outlet end of the spout or funnel outlet.

Therefore, there is a need for a simplified valve or occluding element which does not require a separately constructed valve seat to stop the outflow of fluid from the funnel outlet while minimizing escape of residual fluid from the spout once the valve or occluding element has been positioned to halt the outflow of fluid from the funnel.

Another problem with conventional shut-off elements used in funnels is the necessity to provide a variety of different types of structures for connecting the shut-off element to an actuator mechanism in order to stop and start the outflow of fluid. Where the actuator mechanism and shut-off element combination is not limited in its range of motion, the actuator mechanism and shut-off element can fall out of the funnel, become jammed, or even lost when the funnel is not in use. Where the range of motion is limited, the connection between the actuator mechanism and shut-off element can be cumbersome and assembly can be difficult. For example, where the combination is configured for a limited range of motion, the shut-off element and actuator mechanism must be assembled into the area of the funnel where the connection is to be made. For each connection configuration, there is a tight assembly area, where the funnel provides restriction. This complicates assembly and drives up the cost of manufacturing the funnel assembly, the shut-off element, and the actuator mechanism. This in turn limits the types of structure and methods of formation and manufacture for the component parts of the completed funnel assembly.

Funnel assemblies having a simplified shut-off element and actuator mechanism, which can be constructed simply and inexpensively are disclosed in U.S. Pat. Nos. 5,950,697 (the '697 patent) and 6,341,631 (the '631 patent), both to Hobbs. The '697 and '631 patents disclose a substantially spherical occluding element 112 disposed in a tapered spout 102 of a funnel 100. The diameter of the occluding element 112 is such that it stops the outflow of fluid by sealing the spout 102 close to a funnel outlet 108 thereby minimizing spillage of excess fluid. In addition, the spherical shape of the occluding element 112 permits sealing of the spout 102 at a variety of angular displacements of the occluding element 112.

The position of the occluding element 112 is determined by a wire-like element or actuator 120 protruding from the occluding element 112 and out of the funnel outlet 108. The actuator 120 extends substantially parallel to a spout axis and then bends to form a transverse arm 126 which contacts a rim of a container being filled by the funnel 100 whenever one desires to start the outflow of fluid therefrom. In addition, the '631 patent discloses a method of making a funnel assembly that enables attachment of the occluding element 112 to the actuator 120 before introducing the occluding element 112 and actuator 120 assembly into the funnel 100.

When one desires the outflow of fluid to cease, the '697 patent and the '631 patent both rely on gravity acting on the occluding element and actuator, as well as the weight of the fluid above the occluding element to move the occluding element to a closed position to create a seal between the occluding element and the spout. Consequently, it is desirable to provide an occluding element having a design which improves the seal between the occluding element and spout such that an impervious seal results, thus preventing any leakage of fluid, material, or substance from the spout.

SUMMARY OF THE INVENTION

According to one aspect of the invention, a funnel assembly is provided for transferring material between two containers. The funnel assembly includes a funnel forming a reservoir and a spout of substantially circular cross-section that tapers along a longitudinal axis between an inlet end joined to the funnel and a distal outlet end. The funnel assembly also includes a substantially spherical occluding element disposed in the spout. The occluding element has a diameter greater than a diameter of the outlet end and less than a diameter of the inlet end of the spout. The occluding element has a resilient sealing washer extending circumferentially therearound for selectively engaging an inner wall of the spout to establish an impervious seal within the spout between the inlet and outlet ends as a result of gravity and material weight acting upon the occluding element.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
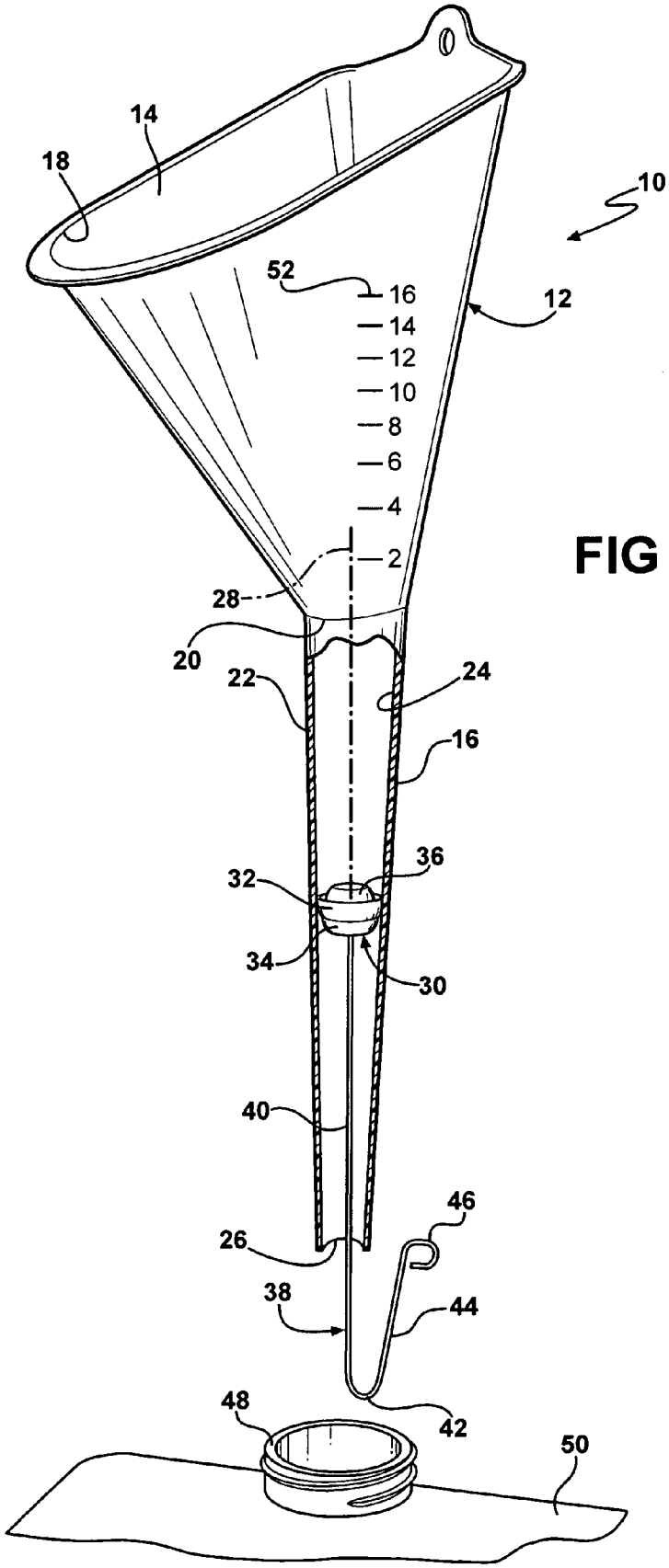
FIG. 1 is a partially cut-away, perspective view of a funnel assembly including an open/closed valve or occluding element and an actuator according to the invention.

Referring to FIG. 1, a funnel assembly is generally shown at 10, for transferring fluid, material, or other substance between two containers. The funnel assembly 10 includes a funnel, generally indicated at 12 forming a reservoir 14 and an outlet tube or spout 16 joined to or integrally formed with the funnel 12. The funnel 12 includes a funnel inlet 18 and, in the usual case, tapers downwardly to an inlet end 20 of the spout 16. The spout 16 includes a wall 22 having a continuously conical inside surface 24 which tapers toward a funnel outlet 26 defining an outlet end of the spout 16. As seen, moving axially from the inlet end 20 to the funnel outlet 26, the continuously conical inside surface 24 converges toward a longitudinal axis 28 of the spout 16. While the description refers to transferring material between two containers, it will be appreciated that the funnel assembly 10 may be used for transferring any of a variety of fluids, materials, or substances without varying from the scope of the invention.

At least in a closed position thereof, an occluding element, generally indicated at 30, is disposed within the spout 16. The occluding element 30 comprises a substantially spherical ball having a resiliently flexible sealing member 32 extending circumferentially therearound, generally horizontally near a midline of the occluding element 30. The occluding element 30 has a diameter larger than a diameter of the cross-section of the continuously conical inside surface 24 of the wall 22 at the funnel outlet 26 and smaller than a diameter of the cross-section of the continuously conical inside surface 24 of the wall 22 at the inlet end 20. In the embodiment shown, the occluding element 30 is formed to include a lower half-spherical portion 34 and an upper half-spherical portion 36. The lower half-spherical portion 34 has a periphery larger than a periphery of the upper half-spherical portion 36. The sealing washer member 32 that extends around the occluding element 30 is integrally formed with the occluding element 30 at the intersection of the upper and lower half-spherical portions 34, 36, approximately at the midline of the occluding element 30. Preferably, the entire occluding element 30 is made from a resiliently compressible material such as a rubber.

The size of the lower half-spherical portion 34 of the occluding element 30 and the extent to which the sealing member 32 extends beyond the periphery of the lower half-spherical portion 34 is chosen depending upon where in the spout 16 one wishes the occluding element 30 to rest when no further material is to be discharged from the funnel outlet 26. Naturally, the closer to the funnel outlet 26 the occluding element 30 is, the smaller will be the amount of material which will escape from the funnel 12 after the spout 16 is closed by the occluding element 30. The sealing member 32 ensures an impervious seal is formed between the occluding element 30 and the spout 16 because the sealing member 32 easily conforms to the continuously conical inside surface 24 of the wall 22 at any of a plurality of angular displacements of the occluding element 30.

Figure 4:
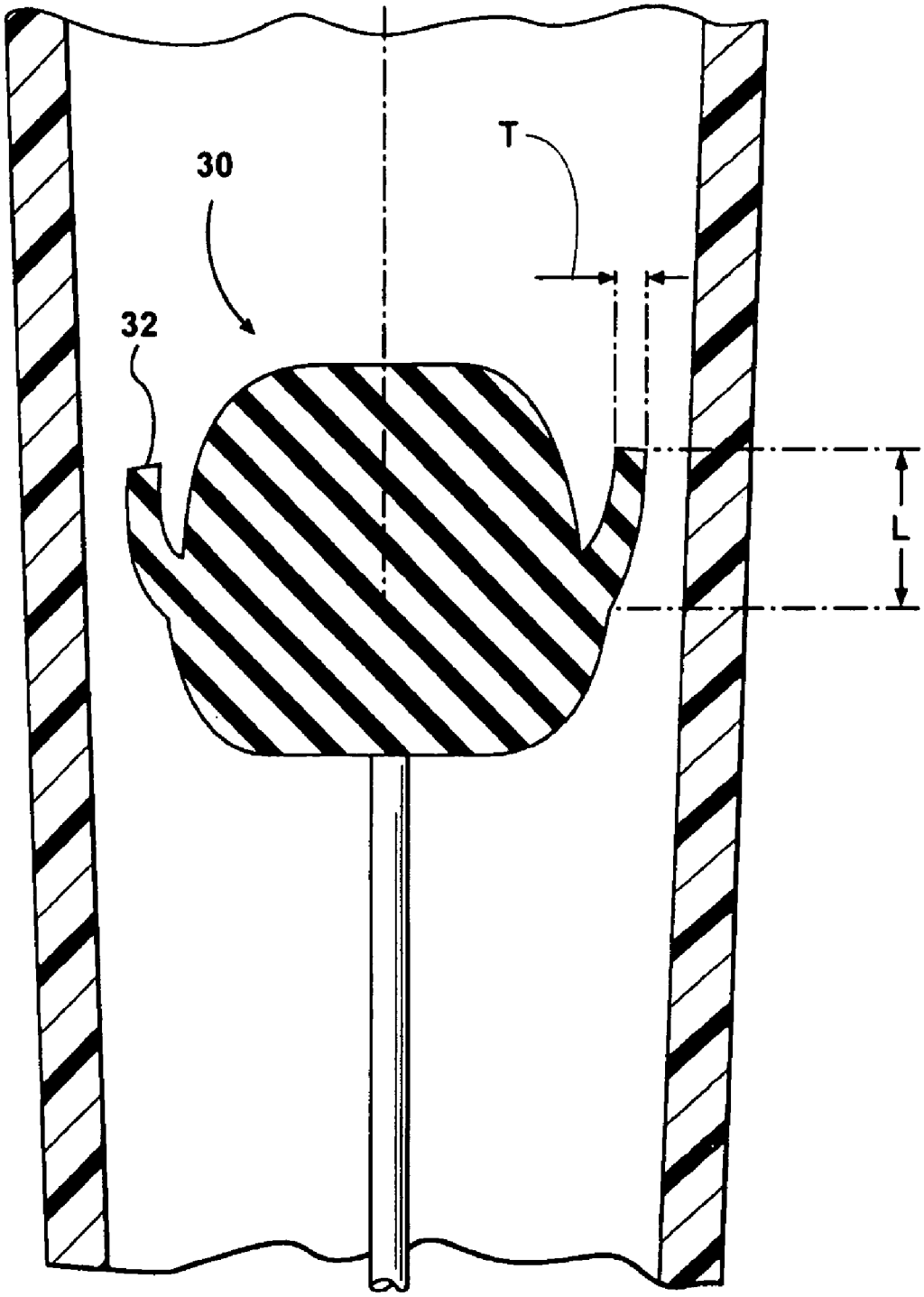
FIG. 4 is an enlarged cross-sectional view of the occluding element including a resiliently flexible sealing member.

In the embodiment shown, the sealing member 32 is formed as an upturned skirt or flap that extends from the periphery of the lower half-spherical portion 34 of the occluding element 30. Referring to FIG. 4, the upturned flap 32 defines a length and a thickness, shown as L and T respectively. The thickness T is small compared to the length L, thus increasing the resiliency and allowing the upturned flap 32 to easily conform to the continuously conical inside surface 24 of the wall 22 when the occluding element 30 is in the closed position. It is appreciated that the length L and flexible nature of the upturned flap 32 provides the ability of the upturned flap 32 to form the impervious seal between the occluding element 30 and the spout 16.

Figure 2:
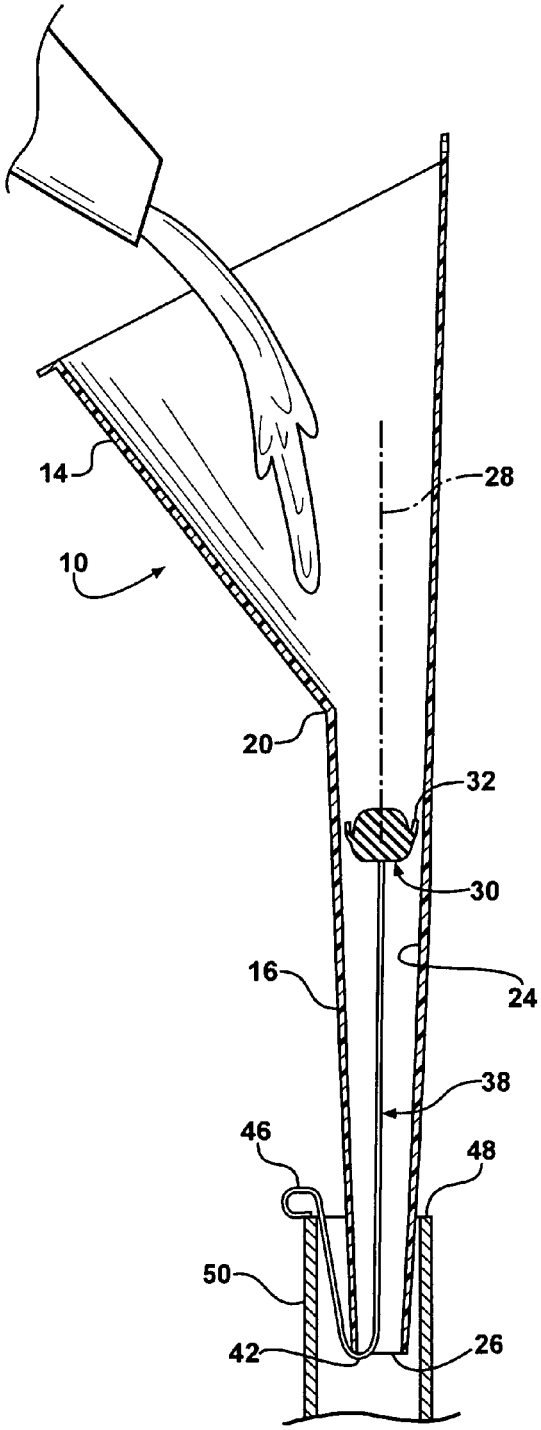
FIG. 2 is a cross-sectional, side view of the funnel assembly illustrating the occluding element in an open position allowing an outflow of material.
Figure 3:
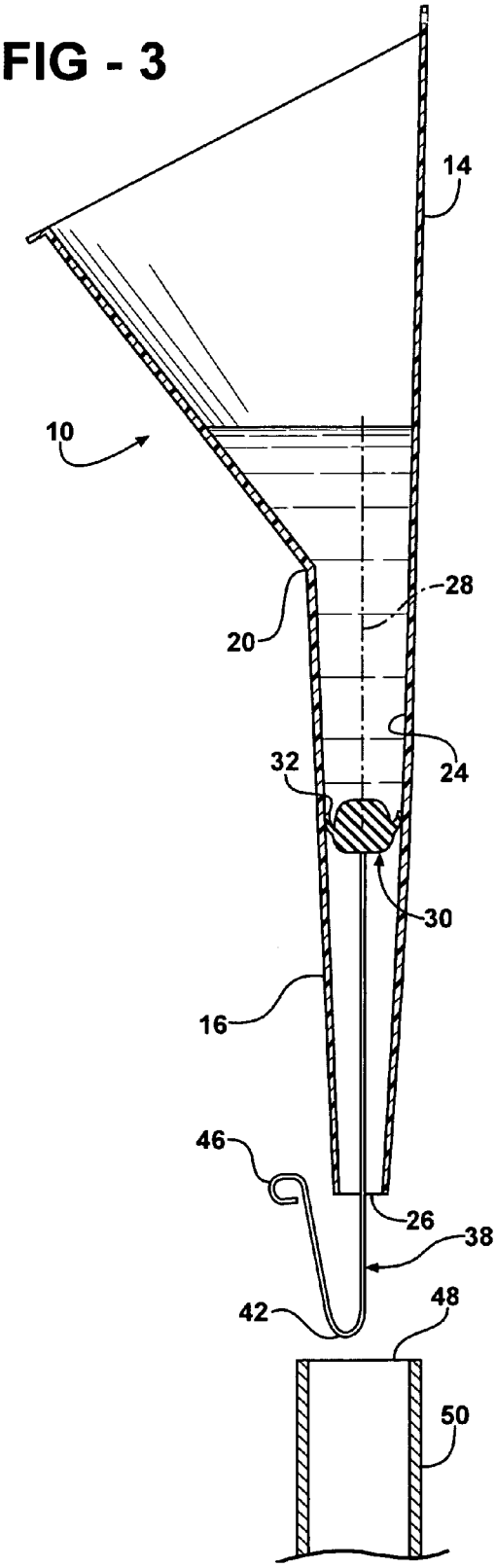
FIG. 3 is a cross-sectional, side view of the funnel assembly illustrating the occluding element in a closed position preventing the outflow of material.

It should be noted that the occluding element 30 need not necessarily comprise a complete spherical ball, but may be truncated, or otherwise non-spherically shaped at its top or bottom with respect to the spout 16. What is required for this invention is that the occluding element 30 include the upturned flap 32 extending therearound for conforming with the continuously conical inside surface 24 of the wall 22 in order to ensure the impervious seal between the occluding element 30 and the spout 16. FIGS. 1 and 3 show the occluding element 30 in the closed position while the occluding element 30 is shown in an open position in FIG. 2.

To manually achieve either the open or closed position of the occluding element 30 in the spout 16, an actuator, generally indicated at 38 in FIG. 1, is coupled to the bottom or lower portion 34 of the occluding element 30. A first portion 40 of the actuator 38 extends downwardly from the funnel outlet 26 in a direction substantially parallel to the longitudinal axis 28 of the spout 16 to a generally 180 degree bend 42 whereat the actuator 38 then has a second portion 44 extending upwardly and terminating in a transversely extending arm or third portion 46.

When the user of the funnel assembly 10 desires an outflow of material from the funnel outlet 26 to commence, the arm 46 is raised toward the funnel inlet 18 to, in turn, raise the occluding element 30 thereby allowing material to flow around the occluding element 30 and out of the funnel outlet 26. In the usual case, the arm 46 would be forced upward, in relation to the funnel outlet, by pressure against a rim 48 of a container 50 into which the material is to be transferred, as shown in FIG. 2. If, however, the container 50 does not conveniently permit the arm 46 to abut the rim 48, as is the case when the spout 16 can only be inserted into the container 50 a short distance, the bend 42 of the actuator 38 may abut structure within the container 50 to raise the occluding element 30. In addition, the user can simply raise the occluding element 30 manually by moving the actuator 38 upward.

When a user desires the outflow of material from the funnel outlet 26 to cease, pressure in an upward direction on the arm 46 or bend 42, which keeps the occluding element 30 in the open position, is released by lifting the funnel assembly 10. When the funnel assembly 10 is lifted, the occluding element 30 will, under the force of gravity and the weight of material above it in the funnel 12, fall to the closed position shown in FIG. 3 to halt the outflow of material from the funnel outlet 26. As the occluding element 30 falls to the closed position, the upturned flap 32 comes into contact with and conforms to the continuously conical inside surface 24 of the wall 22. In the closed position, the flexible nature of the upturned flap 32 allows the upturned flap 32 to conform to any irregularities or deformations present in the continuously conical inside surface 24 of the wall 22 ensuring the impervious seal is formed between the occluding element 30 and the spout 16, thus preventing any leakage from the spout 16.

The advantage of using the occluding element 30 having the resiliently flexible upturned flap 32 extending therearound inside the angled or tapered spout 16 as described above is that the exact position of the occluding element 30 is not important. The conformable nature of the upturned flap 32 may offer advantages of: (1) creating an effective impervious seal by simply allowing the occluding element 30 to fall to a lowest point possible within the spout 16; (2) eliminating the need for a separately machined or molded valve seat; (3) eliminating the need to maintain tight manufacturing tolerances of the continuously conical inside surface 24 of the wall 22; (4) eliminating the requirement of parallelism between the actuator 38 and the longitudinal axis 28 of the spout 16; and (5) increasing the range of angular displacements at which the occluding element 30 will create the effective impervious seal.

Further adding to the simplicity of the invention is the fact that the actuator 38, which actuates upward motion of the occluding element 30, need not be perfectly angularly aligned with respect to the longitudinal axis 28 of the spout 16, since angular rotation of a substantially spherically shaped occluding element 30 with the upturned flap 32 extending therearound will not affect the performance of the impervious seal desired.

The actuator 38 can be fabricated from a variety of materials, such as metallic wire or plastic. If the occluding element 30 and actuator 38 are fabricated to form a single unitary construction, then the material used preferably has high flexibility for ease of placement of the occluding element 30 and actuator 38 into the spout 16 with the actuator 38 extending through the funnel outlet 26. For example, the actuator 38 could comprise a linear element bent to the final shape shown in FIG. 1 after the occluding element 30 and attached (or integral) actuator 38 have been positioned with respect to the funnel 12, with the occluding element 30 in the spout 16 and the actuator 38 substantially out of the funnel outlet 26.

The shape of the actuator 38 shown in FIG. 1 is such that the actuator 38 and occluding element 30 cannot unintentionally be upwardly removed from the funnel 12. It will be appreciated that the linear element may be bent to a variety of other shapes to form the actuator 38 without varying from the scope of the invention. The only requirements for the shape of the actuator 38 being: (1) restriction from unintentionally removing the actuator 38 and occluding element 30 back out of the funnel 12, and (2) an initial bend low enough, in relation to the occluding element, that sufficient upward movement of the actuator 38 and occluding element 30 is allowed in order to enable material to flow around the occluding element 30 and out through the funnel outlet 26.

Preferably, the funnel 12 includes a plurality of graduated markings 52 along the reservoir 14, as shown in FIG. 1. The graduated markings 52 allow a user to accurately measure a predetermined amount of material to be transferred from the funnel assembly 10 to the container 50. For example, in order to obtain a specific oil-gas mixture, normally a certain amount of oil must first be measured in a separate measuring cup or beaker and then transferred using a funnel to the container 50 for mixing with the gas. The present invention combines the funnel and measuring container, thus reducing the risk of spillage and eliminating the need for the separate measuring container. It will be appreciated that the graduated markings 52 can be any of a variety of calibrated scales, such as fluid ounces or milliliters, without varying from the scope of the invention.

The invention has been described in an illustrative manner, and it is to be understood that the terminology which has been used is intended to be in the nature of words of description rather than of limitation. Many modifications and variations of the present invention are possible in light of the above teachings. It is, therefore, to be understood that within the scope of the appended claims, the invention may be practiced other than as specifically described.

What is claimed is:

1. A funnel assembly for transferring material between two containers, said funnel assembly comprising:

a funnel forming a reservoir;

a spout of substantially circular cross-section tapering along a longitudinal axis between an inlet end joined to said funnel and a distal outlet end, said spout having an inside surface; and a substantially spherical occluding element disposed in said spout and having a periphery larger than said outlet end of said spout and smaller than said inlet end of said spout, characterized by said occluding element having a resiliently flexible sealing member extending circumferentially therearound for selectively engaging and conforming to said inside surface of said spout at any of a plurality of angular displacements of said occluding element to establish an impervious seal within said spout between said inlet end and said outlet end as a result of gravity and material weight acting upon said occluding elements;

wherein said sealing member is an upturned flap disposed generally horizontally around a midline of said occluding element and extending from said periphery of said occluding element defining a length and a thickness wherein said thickness is less than said length.

2. A funnel assembly as set forth in claim 1 wherein said occluding element includes a lower portion and an upper portion joined together approximately at said midline and wherein said lower portion has a periphery larger than a periphery of said upper portion.

3. A funnel assembly as set forth in claim 2 wherein said occluding element includes said upturned flap integrally formed with said occluding element approximately at said midline of said occluding element.

4. A funnel assembly as set forth in claim 1 further including an actuator having a first end fixedly secured to said occluding element below said upturned flap and an opposite second end extending through said outlet end of said spout for selectively moving said occluding element from a closed position preventing a flow of material through said spout to an open position allowing said flow of material through said spout.

5. A funnel assembly as set forth in claim 4 wherein said actuator is made of a stiff bendable material to allow bending of said actuator to prevent unintentional removal of said occluding element and said actuator from said funnel assembly.

6. A funnel assembly as set forth in claim 5 wherein said actuator has at least one structure formed in said actuator below said outlet end of said spout to limit movement of said actuator in a direction of said inlet end of said spout.

7. A funnel assembly as set forth in claim 6 wherein said at least one structure formed in said actuator below said outlet end of said spout to limit movement of said actuator is a bend in said actuator sufficient to prevent said actuator from passing completely back through said outlet end of said spout.

8. A funnel assembly as set forth in claim 7 wherein said actuator includes a first portion extending downwardly from said occluding element and out through said outlet end of said spout to a generally 180 degree bend, a second portion extending upwardly from said generally 180 degree bend to a third portion, and said third portion extending transversely.

9. A funnel assembly as set forth in claim 8 wherein said occluding element and said actuator are formed as a single piece.

10. A funnel assembly as set forth in claim 9 wherein said funnel includes a plurality of graduated markings for measuring the material in said funnel.

11. An open/closed valve for adaptation into an existing funnel having a spout of substantially circular cross-section tapering from an inlet end to an outlet end and having an inside surface, said valve comprising:

a substantially spherical occluding element disposed in the spout and having a periphery larger than the outlet end of the spout and smaller than the inlet end of the spout, characterized by said occluding element having a resiliently flexible sealing member extending circumferentially therearound for selectively engaging and conforming to the inside surface of the spout at any of a plurality of angular displacements of said occluding element to establish an impervious seal within the spout between the inlet end and the outlet end as a result of gravity acting upon said occluding element, wherein said sealing member is an upturned flap disposed generally horizontally around a midline of said occluding element and extending from said periphery of said occluding element defining a length and a thickness wherein said thickness is less than said length; and an actuator having a first end fixedly secured to said occluding element below said upturned flap and an opposite second end extending through the outlet end of the spout for selectively moving said occluding element from a closed position preventing a flow of material through the spout to an open position allowing said flow of material through the spout.

12. A valve as set forth in claim 11 wherein said occluding element includes a lower portion and an upper portion joined together at said midline wherein said lower portion has a periphery larger than a periphery of said upper portion.

13. A valve as set forth in claim 12 wherein said occluding element includes said upturned flap integrally formed with said occluding element approximately at said midline of said occluding element.

14. A valve as set forth in claim 11 wherein said actuator is made of a stiff bendable material to allow bending of said actuator to prevent unintentional removal of said occluding element and said actuator from the existing funnel.

15. A valve as set forth in claim 14 wherein said actuator has at least one structure formed in said actuator below the outlet end of the spout to limit movement of said actuator in a direction of the inlet end of the spout.

16. A valve as set forth in claim 15 wherein said at least one structure formed in said actuator below the outlet end of the spout to limit movement of said actuator is a bend in said actuator sufficient to prevent said actuator from passing completely back through the outlet end of the spout.

17. A valve as set forth in claim 16 wherein said actuator includes a first portion extending downwardly from the occluding element and out through the outlet end of the spout to a generally 180 degree bend, a second portion extending upwardly from said generally 180 degree bend to a third portion, and said third portion extending transversely.

18. A valve as set forth in claim 17 wherein said occluding element and said actuator are formed as a single piece.

19. A funnel assembly for transferring material between two containers, said funnel assembly comprising:

a funnel forming a reservoir;

a spout of substantially circular cross-section tapering along a longitudinal axis between an inlet end joined to said funnel and a distal outlet end, said spout having an inside surface; and a substantially spherical occluding element disposed in said spout and including an upper portion, a lower portion joined to said upper portion at a midline of said occluding element and having a periphery larger than a periphery of said upper portion whereby said periphery of said lower portion is larger than said outlet end of said spout and smaller than said inlet end of said spout, and a resiliently flexible sealing member integrally formed at said midline and extending circumferentially therearound for selectively engaging and conforming to said inside surface of said spout at any of a plurality of angular displacements of said occluding element to establish an impervious seal within said spout between said inlet end and said outlet end as a result of gravity and material weight acting upon said occluding element;

wherein said sealing member is an upturned flap disposed generally horizontally around said midline of said occluding element and extending from said periphery of said lower portion defining a length and a thickness wherein said thickness is less than said length.

20. A funnel assembly as set forth in claim 19 further including an actuator having a first end fixedly secured to said occluding element below said upturned flap and an opposite second end extending through said outlet end of said spout for selectively moving said occluding element from a closed position preventing a flow of material through said spout to an open position allowing said flow of material through said spout.

21. A funnel assembly as set forth in claim 20 wherein said actuator is made of a stiff bendable material to allow bending of said actuator to prevent unintentional removal of said occluding element and said actuator from said funnel assembly.

22. A funnel assembly as set forth in claim 21 wherein said actuator has at least one structure formed in said actuator below said outlet end of said spout to limit movement of said actuator in a direction of said inlet end of said spout.

23. A funnel assembly as set forth in claim 22 wherein said at least one structure formed in said actuator below said outlet end of said spout to limit movement of said actuator is a bend in said actuator sufficient to prevent said actuator from passing completely back through said outlet end of said spout.

24. A funnel assembly as set forth in claim 23 wherein said actuator includes a first portion extending downwardly from said occluding element and out through said outlet end of said spout to a generally 180 degree bend, a second portion extending upwardly from said generally 180 degree bend to a third portion, and said third portion extending transversely.

25. A funnel assembly as set forth in claim 24 wherein said occluding element and said actuator are formed as a single piece.

26. A funnel assembly as set forth in claim 25 wherein said funnel includes a plurality of graduated markings for measuring the material in said funnel.

* * * * *